United States Patent [19]

Chastine et al.

[11] Patent Number: 4,490,990

[45] Date of Patent: Jan. 1, 1985

[54] HIGH-SIDE REFRIGERATION SYSTEM ASSEMBLY ADAPTED TO BE MOUNTED IN A REFRIGERATOR MACHINERY COMPARTMENT

[75] Inventors: Gary L. Chastine; Norbert P. Haag, both of Louisville, Ky.

[73] Assignee: General Electric Company, Louisville, Ky.

[21] Appl. No.: 566,788

[22] Filed: Dec. 29, 1983

[51] Int. Cl.[3] ..... F25B 47/00

[52] U.S. Cl. ..... 62/279; 62/295; 62/448; 62/455

[58] Field of Search ..... 62/279, 295, 448, 455

[56] References Cited

U.S. PATENT DOCUMENTS

| | | | |
|---|---|---|---|
| 2,257,374 | 9/1941 | Fritz | 62/116 |
| 2,462,115 | 2/1949 | Luecke | 62/116 |
| 2,685,178 | 8/1954 | Eck | 62/115 |
| 3,116,614 | 1/1964 | King | 62/283 |
| 3,116,615 | 1/1964 | Harle | 62/283 |
| 3,225,563 | 12/1965 | Braun | 62/277 |
| 3,230,734 | 1/1966 | Koch | 62/277 X |
| 3,433,031 | 3/1969 | Scheitlin et al. | 62/448 |
| 3,524,329 | 8/1970 | Smith et al. | 62/295 |
| 3,712,078 | 1/1973 | Maynard et al. | 62/448 |
| 3,736,768 | 6/1973 | Harbour et al. | 62/455 |
| 3,785,168 | 1/1974 | Domingorene | 62/455 |
| 4,023,380 | 5/1977 | Drouin | 62/279 |
| 4,156,352 | 5/1979 | Gelbard et al. | 62/285 |

*Primary Examiner*—Lloyd L. King

*Attorney, Agent, or Firm*—Frank P. Giacalone; Radford M. Reams

[57] ABSTRACT

This invention relates to a refrigerator and more particularly to providing a unitary high-side refrigeration system component unit which can be adapted for mounting in machinery compartments of different designs. Essentially, the unitary high-side refrigeration component unit is designed so that selected high-side components forming refrigeration systems of varying capacities may be assembled as a part of the unit or interchanged to be accommodated in machine compartments of different designs.

5 Claims, 8 Drawing Figures

HIGH-SIDE REFRIGERATION SYSTEM ASSEMBLY ADAPTED TO BE MOUNTED IN A REFRIGERATOR MACHINERY COMPARTMENT

BACKGROUND OF THE INVENTION

The present invention relates generally to refrigerators of the type wherein the high-side components of the refrigeration system are arranged in a machinery compartment which is generally isolated from the food storage compartment of the refrigerator.

In many refrigerators, such as that disclosed in U.S. Pat. No. 4,156,352 Gelbard et al assigned to the General Electric Company, the assignee of the present invention, a motor compressor and a condenser are mounted in a machinery compartment at the bottom of a cabinet and a fan is provided for circulating air through the compartment and over the components. While the arrangement of locating the high-side refrigerator components in a single machinery compartment is an acceptable way of isolating the heat generating components from the food compartment being refrigerated, it has some drawbacks. Generally, the size of the machinery compartment is kept at a minimum so that maximum cabinet space may be devoted to the refrigerated portion of the cabinet. Placing all of the high-side components in a relatively small compartment poses certain manufacturing problems in securing individual components. In part, this has been solved in some instances by creating unitary assemblies such as that disclosed in U.S. Pat. No. 3,524,329, wherein the compressor, condenser and an air circulating means are mounted on a supporting member which is adapted to be inserted into and removed from the refrigerator machinery compartment. It has also been common practice to direct condensate water from the evaporator to a condensate collection pan located in the machinery compartment where it may be evaporated by the circulating air over the relatively warm high-side refrigerator components to raise its temperature. In producing refrigerators having different capacities, it is necessary that different compressors and condensers be provided for each capacity refrigerator. Further, this also may require that the dimensions of the machinery compartment for each capacity be different. This results in manufacturing a separate and completely different high-side system having a different capacity and/or configuration for each capacity refrigerator including the support structure. This results in the necessity of maintaining a number of separate unitary high-side refrigerant components assembly for each capacity or model refrigerator which is costly and space consuming.

SUMMARY OF THE INVENTION

By the present invention a unitary high-side assembly is provided wherein a support member is adapted to receive components covering a wide range of capacities and configurations and which assembly is adapted to be inserted in the machinery compartment of refrigerators having a wide range of capacities.

Accordingly, it is an object of the present invention to provide a high-side refrigeration system which is assembled as a complete unitary system prior to its installation in a selected refrigerator machinery compartment. A household refrigerator is provided including a cabinet having a food compartment to be refrigerated in the upper portion thereof. The food compartment is separated by an insulated partition to include a machinery compartment in the lower portion of the cabinet having an air inlet opening and an air outlet opening. A unitary high-side refrigeration apparatus is arranged in the machinery compartment which includes a condenser, a compressor and a fan means for circulating air through the machinery compartment. The unitary removable refrigeration apparatus comprises a support member arranged in the machinery compartment having a bottom wall and an upwardly extending peripheral wall having front and rear walls and end walls defining a condensate collection area.

Securing means on the support member are adapted to engage locating means in the machinery compartment for positioning and securing the unitary high side refrigerating apparatus in the machinery compartment. An impervious wall is arranged on the bottom wall of the support member extending upwardly to a position below the upper edge of the peripheral wall to define a condensate overflow containment area in the support member which allows overflow condensate from the collecting area to flow into the containment area. Also provided on the support member is a compressor support means including resilient means positioned in the containment area which is interposed between the compressor and the bottom wall of the support member. The resilient means is dimensioned for supporting the compressor relative to the condensate overflow containment area so that overflow condensate in the containment area contacts the relatively warm compressor to thereby be evaporated by the heat generated by the operating compressor. Fan support means are provided for locating the wall on which the fan is arranged relative to the support member. The fan support means includes parallel spaced wall portions positioned adjacent the front and rear walls of the support member. The space between the wall portions is dimensioned to provide at least one pair of spaced receiving areas at a location between the compressor and one of the end walls of the peripheral wall of the support member. A fan mounting wall is removably arranged in at least one pair of receiving areas for circulating air through the machinery compartment between the air inlet area and the air outlet area. The condenser includes at least one serpentine section folded to provide a plurality of substantially parallel spaced pairs of tube runs. The condenser is supported on means located on the edge of the support member toward the air inlet opening. The support means are dimensioned to engage a spaced pair of the folded tube runs of the condenser for securing the condenser in the air inlet area relative to the support member.

DESCRIPTION OF THE PREFERRED EMBODIMENT

Figure 1:
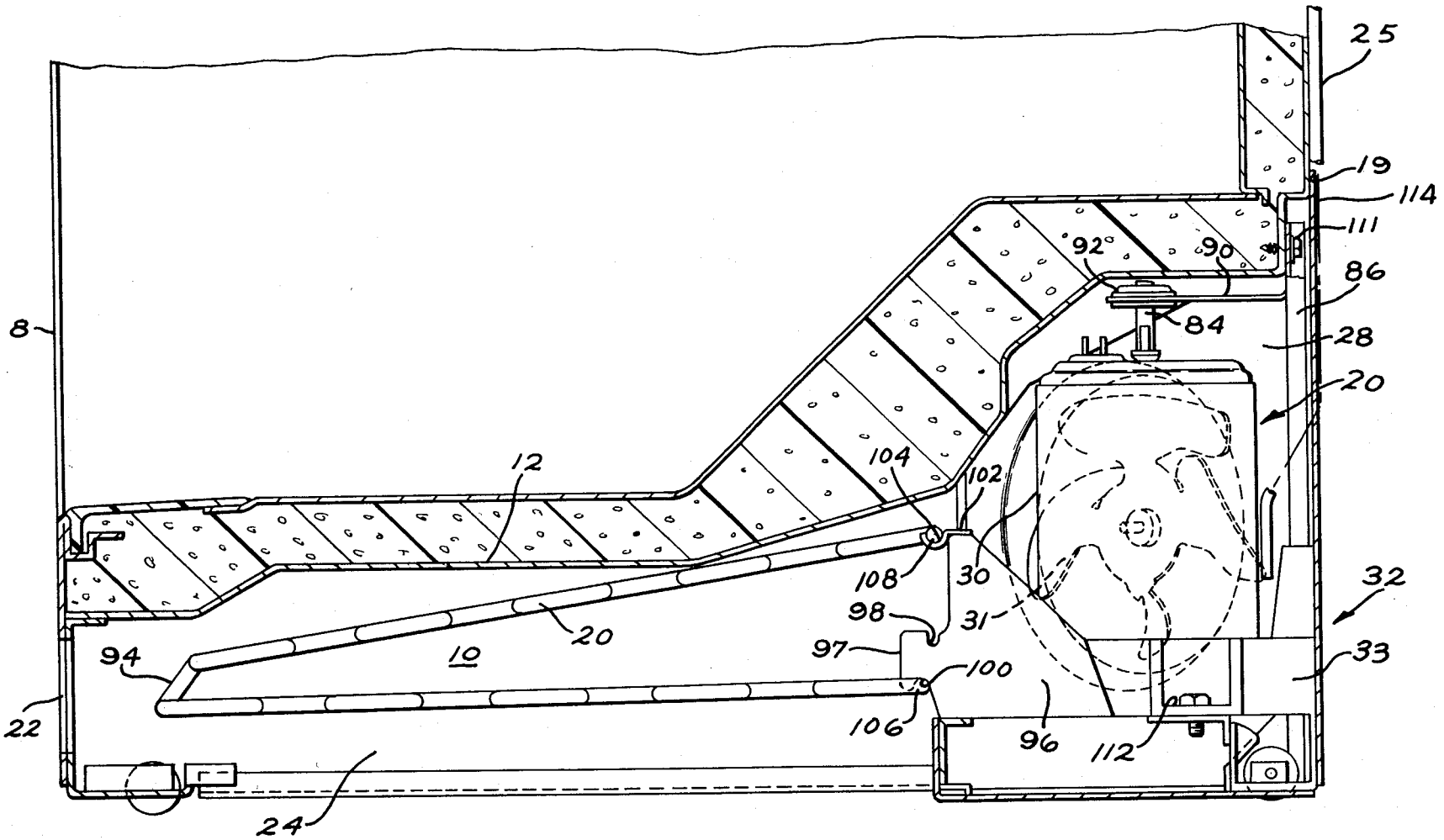
FIG. 1 is a vertical sectional view of a portion of a refrigerator showing the machinery compartment and unitary high-side refrigerator components arrangement of the invention.

Referring now to the accompanying drawings, and more particularly to FIG. 1, there is shown a portion of a household refrigerator cabinet 8 including a machinery compartment 10 in the lower portion of the cabinet. The compartment 10 is separated from the refrigerated portion of the cabinet by an insulated wall 12 and is further defined by side walls 16 and 18 (FIG. 2) of the cabinet and a rear wall 19 having an opening 20, and has an air inlet opening 22 at the front thereof. Generally, the machinery compartment 10 has a low profile forward section 24 at the front portion thereof for receiving a condenser 26 and a higher profile rear section 28 at the rear portion dimensioned for accommodating the rotary motor compressor unit 30 which is arranged with its axis in the vertical position. It should be noted that in refrigerators of different capacities, the size and configuration of the machinery compartment may vary, not only in width and height but also the shape of wall 12 separating the cabinet.

In accordance with the present invention, the high-side portion of the refrigeration system is assembled as a unitary assembly 32 (FIGS. 3–5) generally including condenser 26, compressor 30 and an air circulating fan 31. The unitary assembly 32 is adapted to be arranged in the machinery compartment 10 through opening 20 in a manner which will be fully explained hereinafter.

Figure 7:
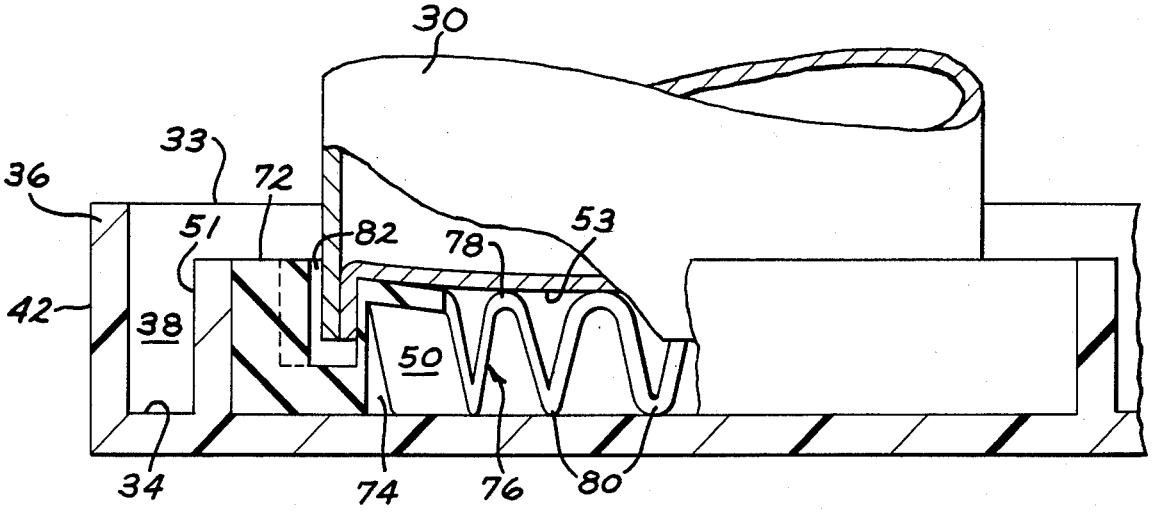
FIG. 7 is an elevational view partly in section and broken away showing the compressor mounting arrangement.
Figure 8:
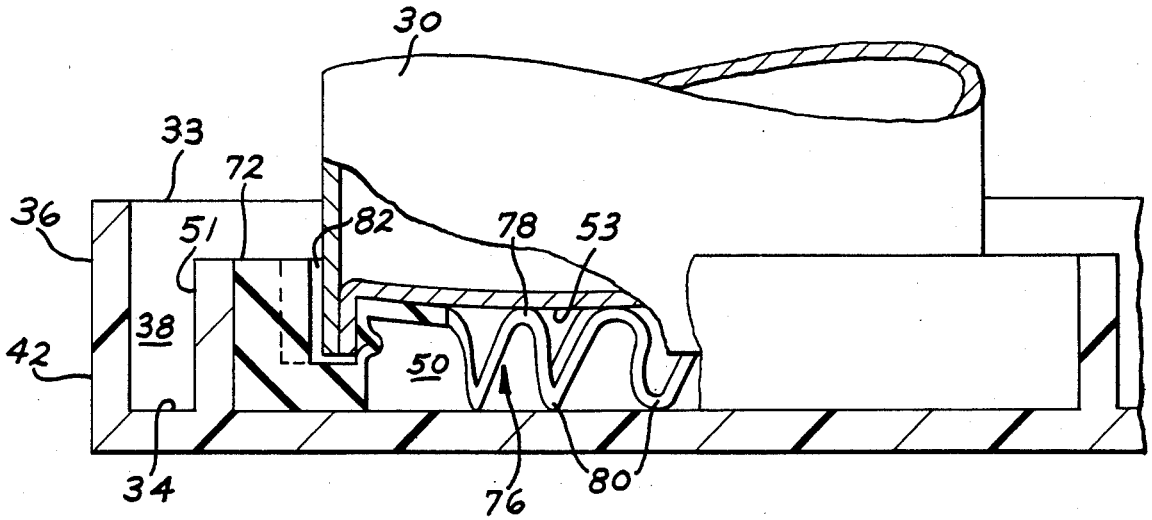
FIG. 8 is a view similar to FIG. 7 showing the interaction between the compressor and mounting elements.

The unitary assembly 32 consists of a formed plastic support member or base 33 which as will be explained below provides a pan used to collect condensate. The base member 33 is substantially a rectangular pan and includes a bottom wall 34 and an upwardly extending peripheral wall 36. As will be explained hereinafter, the base pan is a generic part of the high-side assembly and may be used with components having a wide range of capacities and configurations. The wall 36 is formed to include front and rear wall portions 42, 44 and side walls 46, 48 which define a pan or condensate collection area 38. The base 33 is arranged in compartment 10 so that collection area 38 will receive drain water from the drain tube 25 communicating with the evaporator (not shown) located in the refrigerated portion of the cabinet 8. Air circulating between inlet 22 and outlet 21 under influence of fan 31, as will be explained later, flows across water collected in area 38 to cause its evaporation. Under normal conditions, air flowing across area 38 whose temperature is raised by its scrubbing action across the relatively hot operating components is sufficient to facilitate the evaporation of the condensate collected in area 38. Under certain adverse conditions, such as high humidity conditions, water may collect in area 38 at a rate which exceeds the ability of the air flow through compartment 10 to evaporate it. To this end, in accordance with the present invention, as best seen in FIGS. 7 and 8 means are provided to cause excessive condensate collected in area 38 to flow into a containment area 50. As will be explained hereinafter, the compressor is mounted relative to base pan 33 so that its lower or bottom wall 53 is arranged in containment area 50. Accordingly, excess water flowing into area 50 will come in direct contact with a portion of the relatively hot compressor casing and be heated where its temperature is raised by the relatively hot operating compressor. Thus heated, the condensed water evaporates much faster than that remaining in area 38. As part of the water disposal system, the overflow water containment area 50 is formed by an upwardly extending impervious wall 51 in the collection area 38. The upper edge of the wall 51 is located at an elevation somewhat below the upper edge of peripheral wall 36 so that water enters containment area 51 only when the level of water in collection area 38 rises above the height of wall 51.

The fan 31 is mounted on a fan support wall 52 which is removably mounted on the base 33 in a manner to be explained below. The upper edge portion 54 of wall 52 is configured to mate with the under side of wall 12. With the wall 52 being removable, it is also interchangeable and accordingly the wall 52 is selected according to the configuration of the compartment 10 in which it will be installed. This allows the use of a common base member to be employed for a number of machinery compartment configurations. The wall 52 is provided with a fan opening 56 and is formed to include arms 58 (FIG. 2) extending radially outwardly to a support ring 60. A fan motor 62 is secured in the support ring 60 and includes a shaft whereon the fan 31 is arranged within the fan opening 56.

The wall 52 is adapted to be removably assembled to unitary support 32 in one of at least two positions relative to base 33. Formed on the bottom wall 34 adjacent the front and rear wall portions 42 and 44 are a plurality of pairs of receiving areas 66, 66*a* and 66, 66*b*. In the present instance two pairs, 66, 66*a* and 66, 66*b*, are shown; however, it should be noted that the number of pairs may vary in accordance with the number of machinery compartment configurations. The receiving areas 66, 66*a* and 66*b* are defined by upwardly projecting members 68 spaced to provide the receiving area 66, 66*a* and 66*b* therebetween. The vertical edge portion of wall 52 is formed to include a rail 69 which is dimensioned to be received in a selected pair of receiving areas either between 66, 66*a* as shown or between 66 or 66*b* in the event a wall having a different configuration is required. It should be noted that for other capacity high-side systems a fan having different air moving capacities may be employed and may require different air flow patterns which in turn may require that the fan assembly be arranged in a different position. Further, the high-side assembly may be employed in a refrigerator cabinet wherein the machinery compartment may differ in vertical height and configuration. To this end, a plurality of fan wall receiving areas are formed in the member 33 to accept fan assemblies and, more particularly wall members 52, of different shapes and sizes which will conform to varying machine compartment dimensions and to air moving requirements of different capacity refrigerators.

As mentioned above, the motor compressor 30, as best seen in FIGS. 7 and 8 is mounted so that its lower or bottom wall 53 is in fact located in the containment area 50. The mounting arrangement of the compressor insures that the bottom wall of the compressor casing is spaced from the bottom wall 34 of base member 33 and, accordingly, since condensate will not be present in area 50 during normal conditions, the bottom wall of the compressor will be in contact with condensate water only during the overflow conditions discussed above. Means are provided for resiliently supporting the rotary motor compressor vertically relative to the containment area 50. To this end, a resilient ring shaped member 70 is dimensioned to fit in the containment area 50. The resilient member 70 includes an outer ring portion 72 which is dimensioned to receive the motor compressor casing therewithin and an inner ring portion 74 on which the lower wall 53 of the casing is supported. The outer ring 72 is further dimensioned to substantially fill the area between the compressor outer wall and the wall 51 to provide resilient support or resistance to transverse movement of the compressor relative to its axis. Further, providing resilient members having outer ring 72 of varying radial dimensions allows the use of compressors of varying diameters. This arrangement permits the base pan member to be used in combination with different capacity or sized compressors. The inner ring portion 74 is formed with a convoluted circumferential wall portion 76 which carries the main weight of the compressor. As best shown in FIGS. 7 and 8, the upper apex portions 78 of adjacent convolutions engage the bottom wall 53 of the compressor, while the lower apex portions 80 of adjacent convolutions engage the bottom wall 34 of member 33. This arrangement provides both torsional damping and axial damping of the compressor while supporting the compressor vertically and with its bottom wall 53 in spaced relationship relative to the bottom wall 34 of member 33. To facilitate the flow of water between area 38 and area 50, the outer ring portion 74 is formed with a plurality of circumferentially spaced passageways 82 arranged adjacent the side wall of the compressor which communicates with the area between the convolutions.

The compressor is supported at its upper end to insure its vertical stability. To this end, referring now to FIGS. 4 and 5, the compressor is provided with a stud 84 extending upwardly centrally from the upper wall of the compressor casing and secured thereto. A support structure is provided including a post 86 which is adapted to be slidably supported in a vertical position in a slot 88 formed in the wall rear portion 44 of wall 36. The post 86 includes a support arm 90 extending perpendicular thereto to a position where it overlies the compressor 30. Located on the arm 90 is a resilient grommet 92 which when post 86 is arranged in slot 88 axially aligns with the stud 84. To assemble the support, the compressor is located on the resilient member 70 as described above, and the post 86 inserted in its cooperating slot 88 and lowered until the stud 84 is secured in grommet 92, thereby stabilizing the vertical axis of the compressor 30. This telescoping arrangement of post 86 permits the use of compressors of varying heights which allows the use of the basic pan member to be used in combination with compressors of different capacities.

Figure 6:
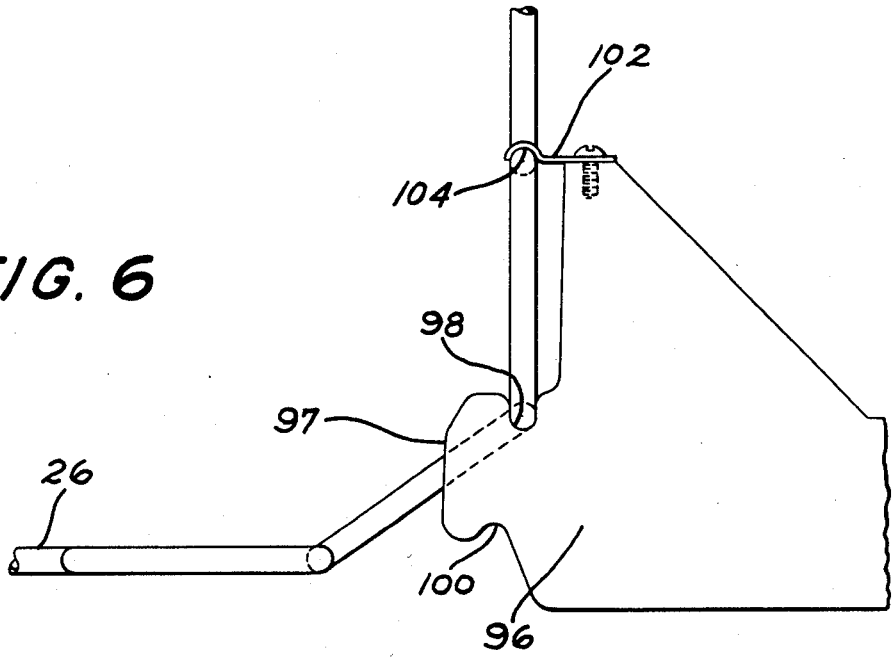
FIG. 6 is a fragmentary elevational view showing the mounting arrangement of the condenser having a different configuration.

Condenser holding means are also provided by the present invention to securely hold the condenser 26 relative to the member 32. Generally, the condenser is formed in a serpentine configuration with a series of parallel passes. The exact configuration of the condenser 26 may vary, depending on the capacity required and the configuration of the machinery compartment 10. For example, in one instance the condenser may be formed of a serpentine section which, as shown in FIG. 1, is folded to provide a V-shaped condenser having an upper and lower section diverging from an apex 94 toward the base 33. In another configuration, a single serpentine section may be provided on the L-shaped condenser, as shown in FIG. 6, having a generally flat section and a smaller folded section extending upwardly therefrom. The present holding means is adapted to support the condensers having either configuration by securing tube passes of the condenser to the base 33. To this end, formed thereon at the forward corners of base 33 are arms 96 which include a member 97 extending forwardly from the front wall 42. Each of the members 97 is formed to include an upwardly facing detent 98 and a lower facing detent 100, each dimensioned to receive one pass of a tube of the condenser 26. Adapted to be secured to the upper portion of arms 96 is a clamp member 102 which includes a detent 104 whose open face may, as will be explained, arranged either as shown in FIG. 1 or FIG. 6. When a V-shaped condenser is to be employed, as shown in FIG. 1, the clamp 102 is secured to the arm 96 so that the open face of detent 104 is facing upwardly. In this instance, the dimension between detents 100 and 104 is slightly less than the vertical spacing between upper and lower diverging end tube passes 106, 108, respectively, at rest so that the tube passes 106, 108 are drawn toward each other when positioned in their respective detents, thus securely holding the V-shaped condenser relative to the base 33.

Figure 3:
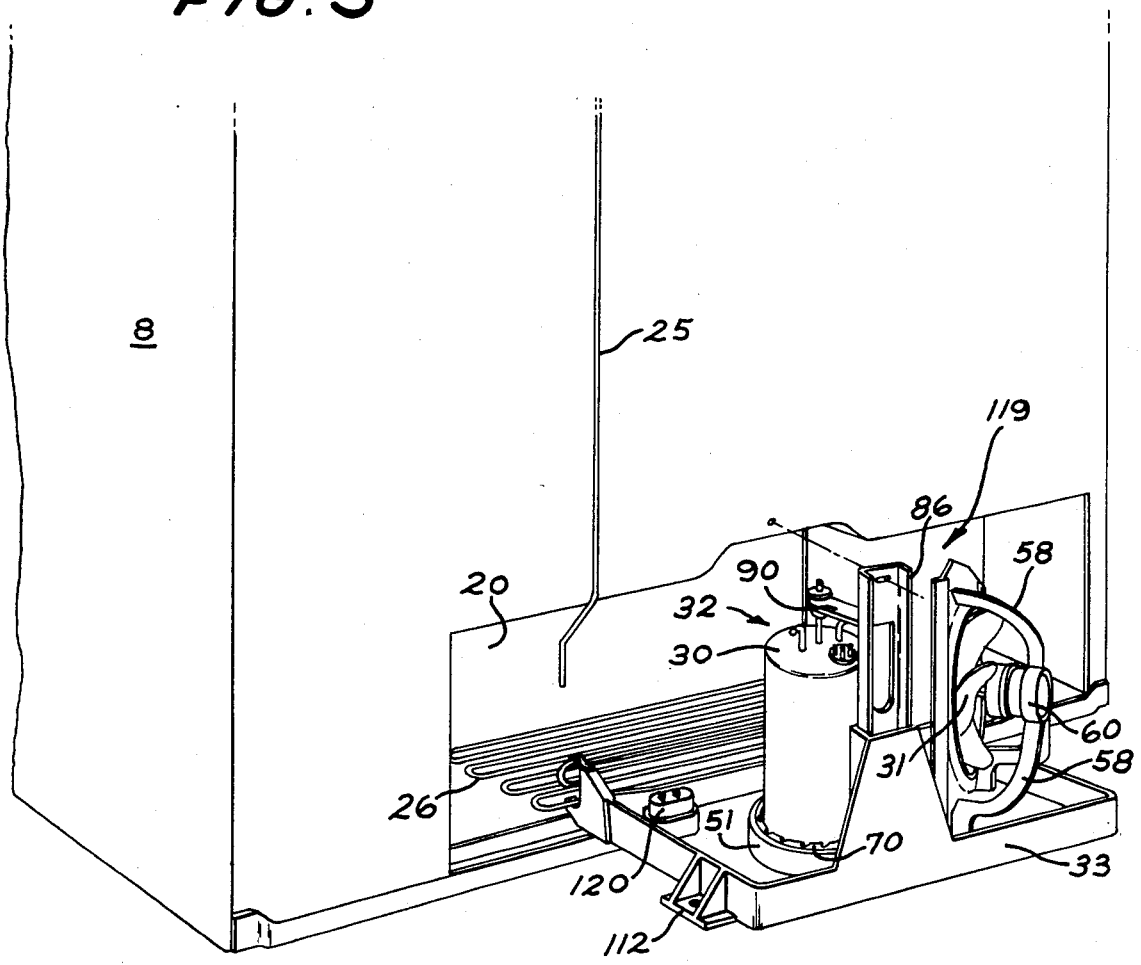
FIG. 3 is a perspective view showing the unitary high-side refrigerator components partially inserted in the machinery compartment.

Alternatively, when an L-shaped condenser is employed, as shown in FIGS. 3 and 6, the clamp 102 is secured to the arm 96 so that the open face of detent 104 is facing downwardly. In this instance, the dimension between detents 98 and 104 is slightly less than the spacing between adjacent tube passes at rest of the upwardly extending portion of the condenser. Accordingly, the adjacent tube passes are drawn toward each other when positioned in their respective detents, thus securely holding the L-shaped condenser relative to the base 33. It should be noted that in either condenser configuration the clamp 102 may first be secured to arm 96 and the condenser, then cammed into the detents or, in the alternative, the lower tube pass of the selected condenser may be placed in its respective lower detent and the clamp 102 then placed to secure the upper tube pass.

Figure 4:
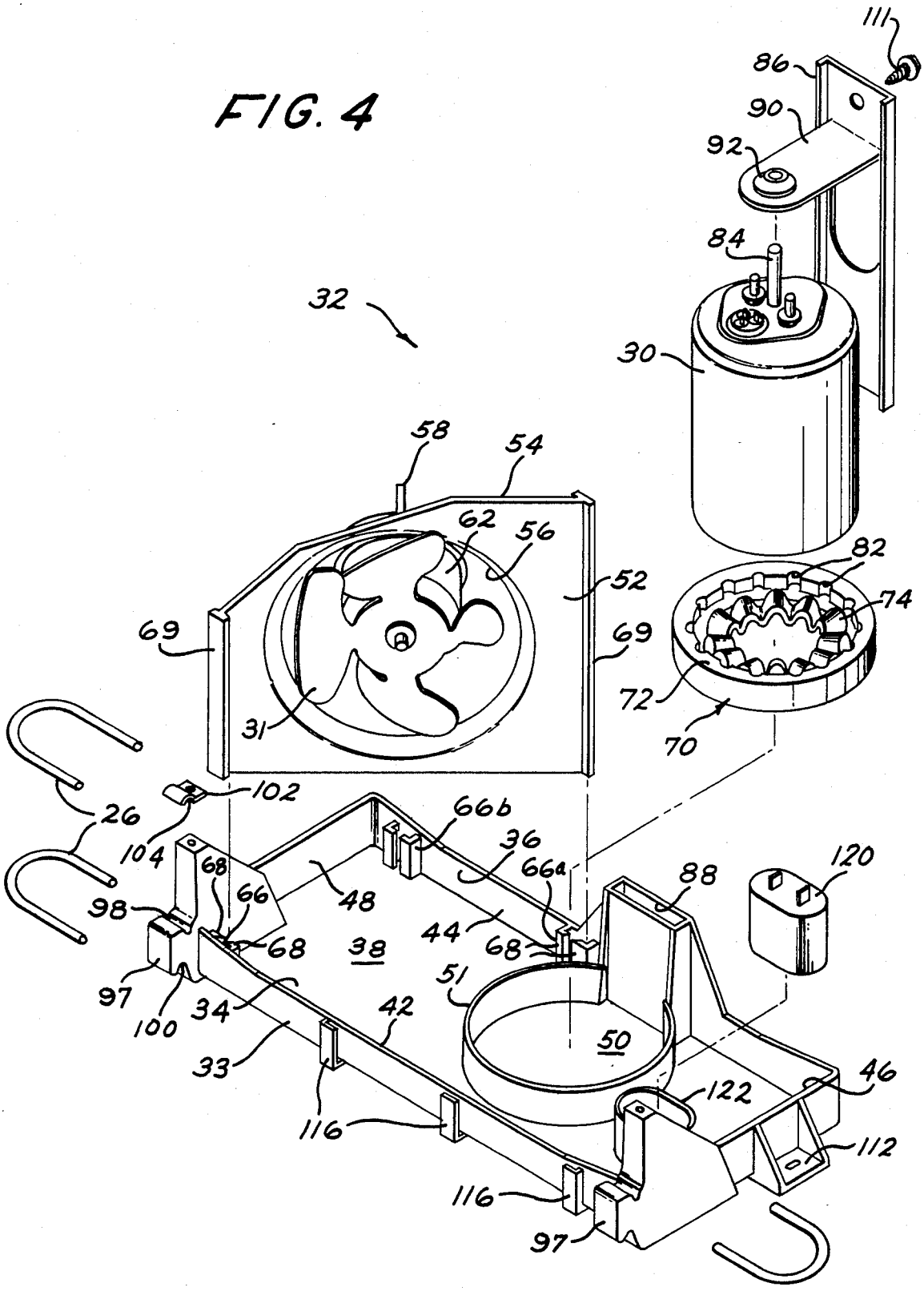
FIG. 4 is an exploded perspective showing various high-side components prior to their assembly.
Figure 5:
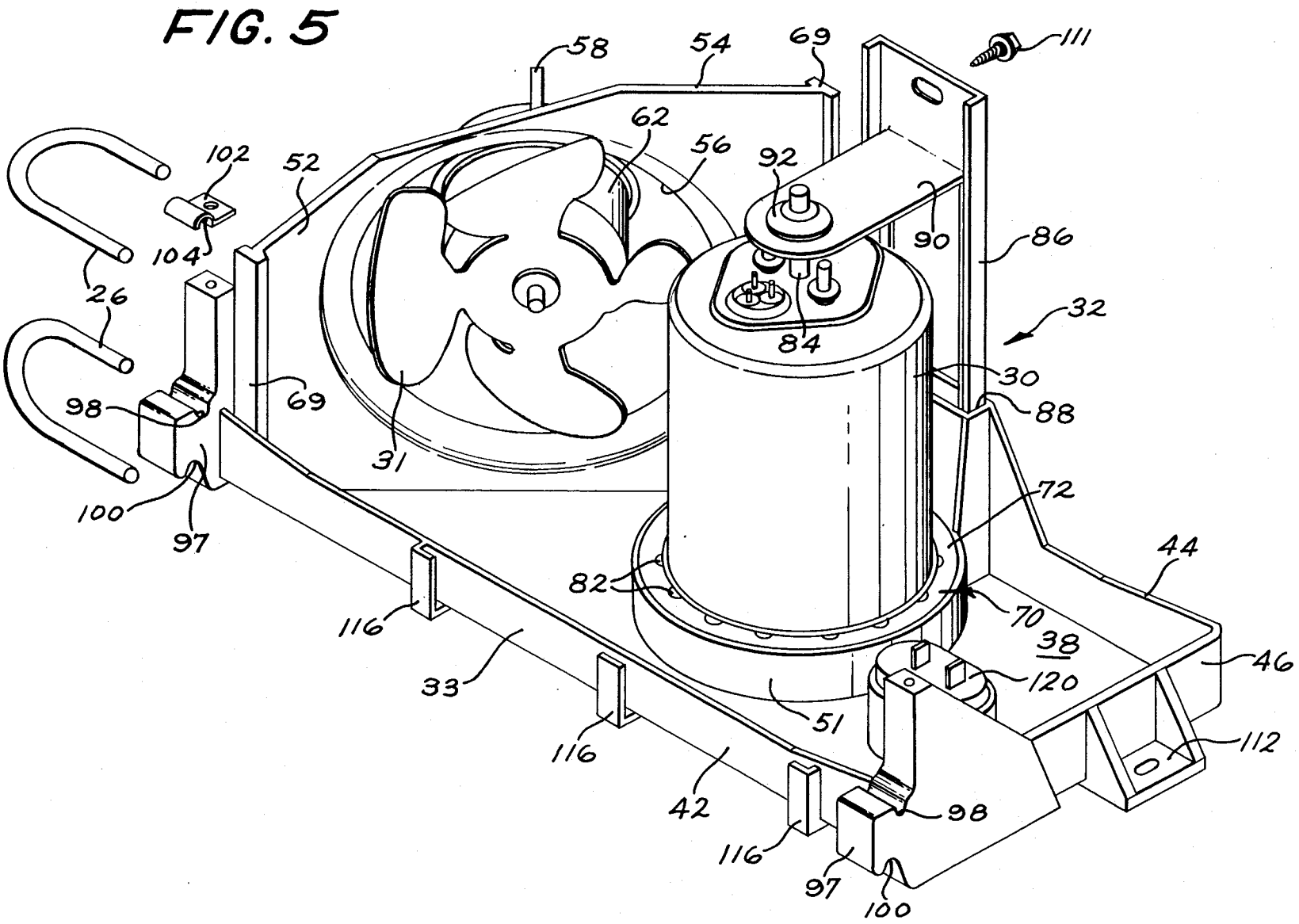
FIG. 5 is a perspective showing the various high-side components assembled.

The base pan 33 may also include means for holding other components of the refrigerator such as the compressor motor capacitor 120. To this end, the base 33 may be formed to include a holding area 122, as shown in FIG. 4, which is dimensioned to securely hold the capacitor 120 as shown in FIGS. 2 and 5.

Figure 2:
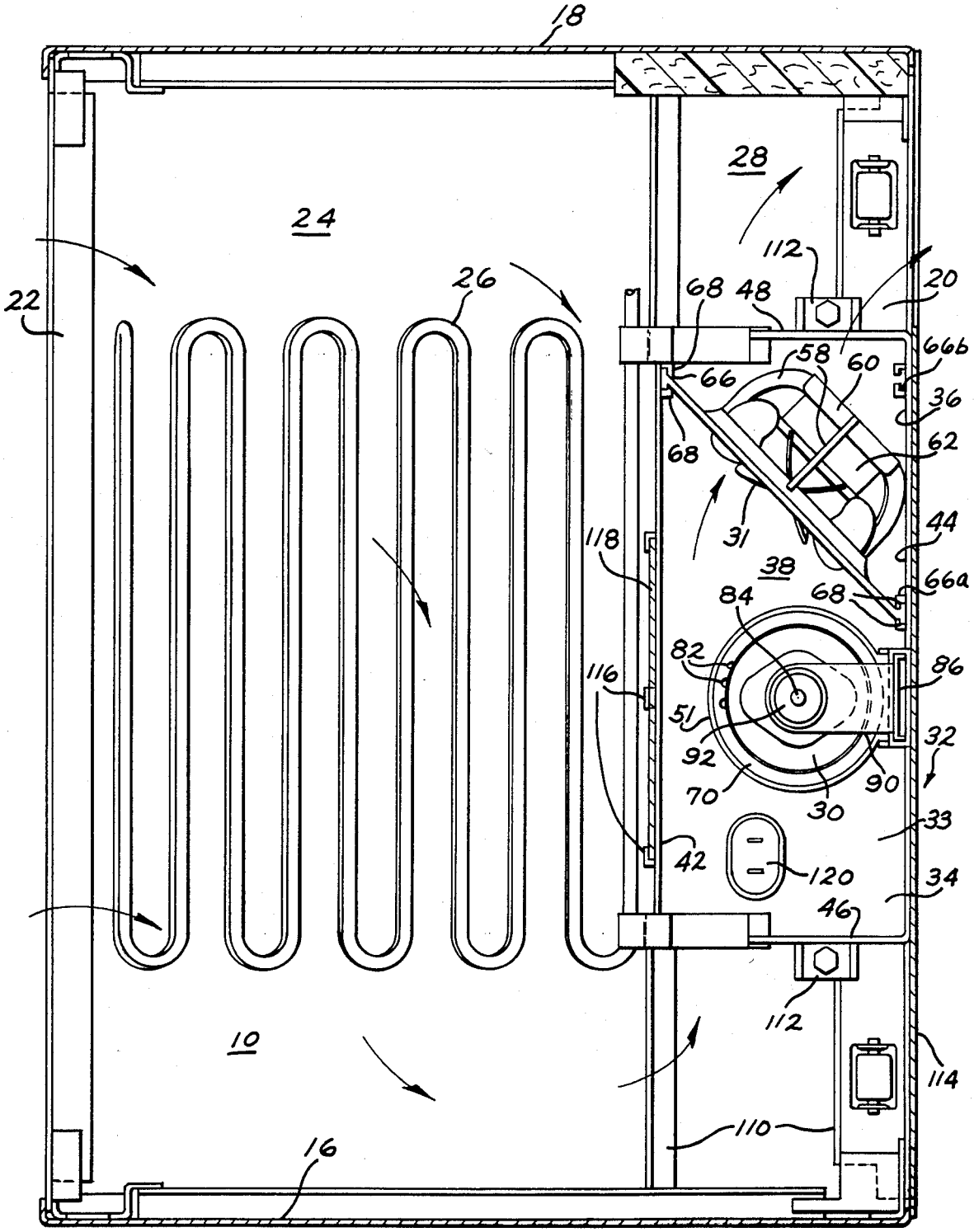
FIG. 2 is a sectional plan view taken along line 2—2 in FIG. 1.

The base pan 33 supporting the high-side refrigerator components is supported in the compartment 10 on transverse braces 110 (FIGS. 1 and 2 which are secured to the cabinet at each end adjacent the walls 16 and 18 in any suitable manner. Formed adjacent the outer side of walls 46 and 48 of the base pan 33 are brackets 112 which are secured to the bracket 110. The bracket 112 includes an elongated opening 113 which allows front-to-rear adjustment of the assembly 32 relative to the rear wall of the cabinet 8. To further stabilize the vertical axis of the compressor, the post 86 is secured at its upper end to the cabinet by a fastening device 111 as shown in FIG. 1.

The assembly may also be provided with means defining an air duct 35 through the assembly 32 to direct air between the air inlet 22 and outlet 20. To this end, the opening 20 is provided with a cover 114 which extends from wall 16 of cabinet 8 to the position adjacent wall 46. In effect, the opening 20 is defined by an area adjacent wall 18. Formed along the front wall 42 are a plurality of holding members 116 which are adapted to support a partition member 118. To complete the duct 35 and for preventing short circuiting or recirculation of air in compartment 10, there is provided an L-shaped panel 119 having a vertical portion 120 or a base portion 122 (FIG. 2) which extends between the wall 48 and cabinet wall 18, adjacent the front portion of member 33. The panel 119 may be supported on holding tabs 124 formed on the member 33 so that it is in fact a part of the unitary assembly 32. The arrangement of cover 114 and partition 118 and panel 119 defines air duct 35 which causes the air to flow from inlet 22 through the assembly 32 and exit through opening 20 as indicated by the air flow arrows in FIG. 2. However, air will also flow directly over the condenser and through fan 31. The partition member may include a sound deadening layer which may be employed to reduce the noise level of the operating components of the unitary assembly 32.

In summary, when refrigerators having different capacities and machine compartment configurations are manufactured it is necessary that the high-side components are assembled which fill the need for each specific refrigerator. By the present invention, there is provided a unitary high-side refrigerator system component assembly which includes a common base pan on which a combination of components are assembled in accordance with the requirements of a particular refrigerator. In employing rotary compressors, for example, the capacity of the compressor may be varied by altering the vertical height of the motor. The present compressor mounting arrangement, as mentioned above, is adapted to accommodate compressors of varying heights and also having slight different diameters. The fan size and air moving capacity can also be accommodated. For example, in one capacity the fan blade diameter is such that the fan supporting wall 52 is mounted in areas 66, **66*b*, as shown, with the axis of the fan arranged diagonally relative to the compartment 10. In the situation where a smaller or lower capacity fan is required, the fan supporting wall 52 is mounted in areas 66, 66*b* with the axis of the fan transverse relative to compartment 10**.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A household refrigerator including:

a cabinet having a compartment to be refrigerated in the upper portion thereof separated by an insulated partition to include a condensing unit compartment in the lower portion of said cabinet having an air inlet opening and an air outlet opening;

a unitary refrigerating apparatus arranged in said condensing unit compartment including a condenser, a compressor and a fan means for circulating air through said condensing unit compartment;

said unitary removable refrigeration apparatus comprising a support member arranged in said condenser unit compartment having a bottom wall and an upwardly extending peripheral wall having side walls and end walls defining a condensate collection area;

securing means on said support member adapted to engage locating means in said equipment compartment for positioning and securing said unitary refrigerating apparatus in said equipment compartment;

an impervious wall on said bottom wall of said support member extending upwardly to a position below the upper edge of said peripheral wall of said support member defining a condensate overflow containment area so as to allow overflow condensate from said condensate collecting area to flow into said containment area;

compressor support means including resilient means in said containment area being interposed between said compressor and said bottom wall of said support member being dimensioned for supporting said compressor in said condensate overflow containment area so that condensate in said containment area contacts said compressor whereby said overflow condensate is evaporated by the heat generated by the operation components of the compressor;

locating means adjacent opposite side wall of said peripheral wall of said support member including parallel spaced wall portions dimensioned to provide at least one pair of spaced receiving areas at a location between said compressor and one of said end walls of said peripheral wall of said support member for supporting said fan mounting wall portion for dividing said condensing unit compartment between said air inlet area and said air outlet area;

a fan supporting wall portion being removably arranged on said support member;

said condenser including at least one serpentine section folded to provide a plurality of substantially parallel spaced pairs of tube runs;

condenser support means on the edge of said support member toward said air openings being dimensioned to engage at least one of said spaced pair of said folded tube runs of said condenser for securing said condenser in said air inlet area relative to said support member.

2. The invention recited in claim 1 wherein said condenser includes an upper and lower serpentine tube section folded to a substantially V-shape with the apex facing said air inlet and the diverging upper and lower portions having end tube passes adjacent said support member.

3. The invention recited in claim 1 wherein said condenser includes a first serpentine tube section and a second serpentine tube section folded to a substantially L-shape with said second section extendupwardly and arranged adjacent said support member.

4. The invention recited in claim 2 wherein said condenser support means includes a tube support member having a first tube holding detent means facing upwardly and a second tube holding detent means facing downwardly, a bracket including a tube holding recess adapted to be arranged in said tube support member in a position above said first and second tube holding detent means whereby said bracket is arranged with said tube holding recess facing upwardly to hold said diverging ends of said V-shaped condenser between said tube holding detent and said second tube holding detent means.

5. The invention recited in claim 5 wherein said bracket is arranged with said tube holding recess facing downwardly to hold adjacent tube passes of said second section of said L-shaped condenser between said tube holding detent and said first tube holding detent means.

* * * * *